US006354202B1

(12) United States Patent
Heiler

(10) Patent No.: US 6,354,202 B1
(45) Date of Patent: Mar. 12, 2002

(54) DAMPENING UNIT OF A PLANOGRAPHIC PRINTING MACHINE

(75) Inventor: Peter Heiler, Forst (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/528,161

(22) Filed: Mar. 17, 2000

(30) Foreign Application Priority Data

Mar. 17, 1999 (DE) ..... 199 11 783

(51) Int. Cl.[7] ..... B41L 25/16

(52) U.S. Cl. ..... 101/148; 101/351.2

(58) Field of Search ..... 101/148, 351.3, 101/352.04, 352.09, 450.1, 451, 452, 351.2; 192/45

(56) References Cited

U.S. PATENT DOCUMENTS

| | | | | | |
|---|---|---|---|---|---|
| 4,290,360 | A | | 9/1981 | Fischer | 101/148 |
| 4,370,926 | A | | 2/1983 | Hattori | 101/352.05 |
| 4,421,027 | A | | 12/1983 | Fischer | 101/148 |
| 4,440,081 | A | * | 4/1984 | Beisel | 101/148 |
| 4,741,269 | A | * | 5/1988 | Aylor et al. | 101/148 |
| 4,872,406 | A | * | 10/1989 | Kusch | 101/148 |
| 4,922,818 | A | * | 5/1990 | Junghans | 101/148 |
| 4,949,637 | A | | 8/1990 | Keller | 101/148 |
| 5,191,835 | A | | 3/1993 | Blanchard | 101/148 |
| 5,269,221 | A | * | 12/1993 | Hachiya et al. | 101/148 |
| 5,540,145 | A | | 7/1996 | Keller | 101/148 |
| 5,884,557 | A | | 3/1999 | Fürbass | 101/148 |

FOREIGN PATENT DOCUMENTS

| | | | | |
|---|---|---|---|---|
| DE | 28 22 350 | | 12/1978 | |
| DE | 29 02 228 | | 7/1980 | |
| DE | 20 09 765 | | 9/1980 | |
| DE | 29 32 105 | | 2/1981 | |
| DE | 29 40 594 | | 4/1981 | |
| DE | 31 16 505 | A1 | 11/1982 | |
| DE | 34 44 951 | A1 | 9/1985 | |
| DE | 36 37 460 | A1 | 7/1987 | |
| DE | 36 41 013 | A1 | 10/1987 | |
| DE | 196 16 328 | A1 | 11/1997 | |
| EP | 0 264 460 | | 4/1988 | |
| EP | 0 462 490 | A1 | 12/1991 | |
| FR | 2499905 | * | 8/1982 | 101/148 |
| GB | 2 044 678 | A | 10/1980 | |
| JP | 15551 | * | 1/1991 | 101/148 |

* cited by examiner

*Primary Examiner*—Stephen R. Funk
(74) *Attorney, Agent, or Firm*—Herbert L. Lerner; Laurence A. Greenberg; Werner H. Stemer

(57) ABSTRACT

A dampening unit of a planographic printing machine has a pan roller, a transfer roller, and a dampening unit roller. The transfer roller is held in bearing contact against the dampening unit roller with a regulating force such as, in particular, a spring force $F_F$. The transfer roller, together with the pan roller, is pivotable about a pivot axis that is offset relative to the roller axis of the pan roller, and/or the pivot axis lies essentially on a tangential line running through a circumferential contact point which is formed by the transfer roller together with the dampening unit roller.

11 Claims, 7 Drawing Sheets

DAMPENING UNIT OF A PLANOGRAPHIC PRINTING MACHINE

BACKGROUND OF THE INVENTION

FIELD OF THE INVENTION

The invention lies in the printing technology field. More specifically, the invention relates to a dampening unit of a planographic printing machine, with a pan roller, a transfer roller, and a dampening unit roller. The transfer roller is held against the dampening unit roller with a regulating force, generated by a weight, gas-pressure, or a spring force (FF). The various rollers, in particular, are ink-friendly and therefore emulsion-carrying rollers.

U.S. Pat. No. 4,290,360 (German patent DE 29 02 228 C2) describes two different embodiments of a dampening unit. In the dampening unit of the first exemplary embodiment described therein (see FIG. 1 of the patent), which corresponds to the generic type mentioned above, a dampening unit roller bears against an applicator roller under the action of a spring, but the dampening unit roller is not pivotable about a pivot axis offset relative to the roller axis of a water pan roller. The water pan roller itself is not pivotable at all. Also, the pivot axis of the dampening unit roller which is coaxial with the water pan roller, does not lie essentially on a tangential line running through a circumferential contact point which is formed by the dampening unit roller together with the applicator roller. Instead, it is far removed from the tangential line. In the second exemplary embodiment described in the patent (see FIG. 5 of the patent) the dampening unit is different from the above-mentioned generic type. A dampening unit roller is mounted, together with a water pan roller, in a carrier and it is pivotable about a pivot axis that is offset relative to the roller axis of the water pan roller and is formed by a journal. Although a spring acting on the carrier ensures that the applicator roller remains in bearing contact against a plate cylinder, the dampening unit roller is not held against the applicator roller under the action of a spring force. Those two dampening units are not so-called emulsion film dampening units or alcohol-free direct film dampening units.

A further dampening unit is described in German published patent application DE 29 09 765. The transfer roller is pivotable about the roller axis of a water pan roller. It is not pivotable about a pivot axis that is offset relative to the roller axis.

A further dampening unit is described in German published patent application DE 28 22 350 A1. There, although a metering roller carried in arms is pivotable about a pivot axis offset relative to the roller axis of a pan roller, the metering roller is not held in bearing contact against a dampening unit roller under the action of a regulating force, such as, for example, a weight, gas-pressure or spring force. Moreover, the pan roller is not pivotable about the offset pivot axis. That prior art dampening unit, furthermore, is not a so-called emulsion film dampening unit, because not all the dampening unit rollers arranged in the transport path of the dampening medium are ink-friendly and, for example, rubberized. For the reasons mentioned above, the dampening unit described contradicts the principle of alcohol-free or reduced emulsion film dampening.

U.S. Pat. No. 4,949,637 describes a further dampening unit, in which each dampening unit roller guides both printing ink and dampening medium and, for this purpose, consists of rubber. The roller is driven at a circumferential speed that corresponds to the circumferential speed of the plate cylinder. Such dampening units are conventionally also designated as alcohol-free or reduced direct film dampening units or emulsion film dampening units. The dampening unit comprises a transfer roller which is mounted in a pivotable supporting element and which is pivotable about the longitudinal axis of a pan roller, certainly not about a pivot axis offset relative to this longitudinal axis. The applied pressure of the transfer roller against the pan roller and the thickness of the film layer conveyed through their roller nip can be set by the adjustment not of the pan roller, but of the transfer roller, along a slotted guide.

A further dampening unit is described in U.S. Pat. No. 5,540,145. That dampening unit is likewise an emulsion film dampening unit and is identical in many features to the just-described dampening unit.

A dampening unit described in Japanese published patent application JP SHO 51-92204 has an applicator roller which can be brought into frictional contact with the plate cylinder by a spring acting on a supporting lever. That dampening unit, however, lacks a pan roller and a transfer roller. The dampening unit comprises a metal roller which supplies the applicator roller with the dampening medium and which is in frictional contact with a body that absorbs dampening medium and the foot of which is dipped into a dampening medium container. The applicator is pivotable, together with the metal roller, about a supporting axis that is offset relative to the roller axis of the metal roller. The dampening medium quantity capable of being conveyed to the printing form by means of the absorbent body is comparatively small, so that that dampening unit is unsuitable for printing machines which print at high printing speeds.

German published patent application DE 29 49 594 A1 describes a dampening unit which has a pan roller, designated as a dampening duct roller, and a dampening applicator roller, but in which the dampening medium is transferred to the dampening applicator roller directly by the dampening duct roller, not via a transfer roller. Although the dampening applicator roller is pivotable about a pivot axis that is offset relative to the roller axis of the dampening duct roller, the dampening duct roller is not pivotable at all.

Furthermore, the prospectus "Printing Without Isopropanol (IPA)" ["Drucken ohne Isopropanol (IPA)"] from the prospectus series "GTO 52-Tips" issued by Heidelberger Druckmaschinen AG mentions a direct film dampening unit, for the operation and care of which instructions are given in the prospectus.

SUMMARY OF THE INVENTION

The object of the invention is to provide a further improved dampening unit for a planographic printing press which overcomes the above-noted deficiencies and disadvantages of the prior art devices and methods of this kind.

With the above and other objects in view there is provided, in accordance with the invention, a dampening unit of a planographic printing machine, such as a rotary offset printing machine, comprising:

- a pan roller rotatably mounted about a pan roller axis;
- a dampening unit roller;
- a transfer roller disposed to be held in bearing contact against the dampening unit roller at a circumferential contact point with a regulating force;
- the transfer roller and the pan roller being pivotably disposed about a pivot axis offset from the pan roller axis of the pan roller, the pivot axis lying substantially on a tangential line running through the circumferential contact point of the transfer roller and the dampening unit roller.

In accordance with an added feature of the invention, the regulating force is produced by a weight, a gas-pressure-generated force, and a spring force.

In accordance with an additional feature of the invention, the pan roller, the transfer roller, and the dampening unit roller are ink-friendly, emulsion-carrying rollers.

The dampening unit of a planographic printing machine, with a pan roller, a transfer roller and a dampening unit roller, the transfer roller being capable of being held in bearing contact against the dampening unit roller by means of a regulating force, in particular a weight, gas-pressure or spring force, is distinguished in that the transfer roller is pivotable, together with the pan roller, about a pivot axis offset relative to the roller axis of the pan roller and the pivot axis lies essentially on a tangential line running through a circumferential contact point which is formed by the transfer roller together with the dampening unit roller.

The fact that the common pivot axis of the transfer roller and of the dampening unit roller lies exactly or approximately on a common tangential line of the transfer roller and of the dampening unit roller, the tangential line running perpendicularly to the normal line along which the transfer roller is thrown onto the dampening unit roller, is highly advantageous in terms of a mounting which is free of any reaction to the pressure of the transfer roller against the dampening unit roller. If the circumferential contact point, through which the tangential line runs, is a slip-through nip formed by the transfer roller together with the dampening unit roller, the shear force taking effect in the slip-through nip during the shearing of the dampening-medium or emulsion film cannot exert any torque pivoting the transfer roller about the pivot axis. The force with which the transfer roller is thrown onto the dampening unit roller and which is generated by the regulating force therefore always remains constant, even in the event of variations in the shear force in the slip-through nip which are caused, for example, by a variation in the speed difference between the circumferential speeds of the transfer roller and of the dampening unit roller.

The fact that the pivot axis is offset relative to the roller axes of the pan roller and of the transfer roller makes it possible for the two rollers to be mounted in the same roller carrier, whilst the press-strip width in the nip of the two rollers can be adjustable by the displacement of the pan roller by an adjustment means. This is highly advantageous with regard to an accurately reproducible throw of the transfer roller onto the dampening unit roller, as also explained in detail at a later juncture.

As regards the design of the dampening unit as an emulsion or direct film dampening unit, each of the two measures, that is to say, on the one hand, the offset of the pivot axis and, on the other hand, the arrangement of the latter on or near the tangential line, is advantageous in itself and independently of the other in each case, and particular advantages arise from the combination of these measures.

In the dampening unit according to the invention, moreover, the pressure of the transfer roller against the dampening unit roller is advantageously self-regulating due to the regulating force. The width of the press strip formed by the transfer roller together with the dampening unit roller can be kept constant over the entire service life of these rollers by means of the force-accentuated throw of the transfer roller onto the dampening unit roller. This is a considerable advantage, as compared with an ex factory fixed setting of the rollers or as compared with a roller setting to be readjusted manually at regular intervals by the user.

In contrast to the prior art manufacturer-fixed setting of the rollers, in the dampening unit according to the invention variations in the diameter of the damping unit roller and/or of the transfer roller which occur as a consequence of use present no problems at all and are compensated by the action of the regulating force in the appropriate setting direction. The variations in diameter which are referred to may have various causes.

On the one hand, a circumferential rubber coating of the dampening unit roller may swell up due to the action of dampening medium or washing medium, with the result that the diameter of the dampening unit roller increases.

On the other hand, such a soft-elastic dampening unit roller, by rolling on the transfer roller, may experience wear. If, during the operation of the dampening unit, the dampening unit roller and the transfer roller roll on one another at mutually different circumferential speeds, even greater abrasion of the dampening unit roller may occur. The diameter of the dampening unit roller decreases due to wear and abrasion.

As a rule, the two effects are superposed, for example, in a first stage, the swelling up of the dampening unit roller and, in a subsequent second stage, the abrasion of the dampening unit roller being the predominant effect, so that the diameter of the dampening unit roller fluctuates over its service life.

In the highly maintenance-friendly dampening unit according to the invention, there is no need for any check of the press-strip width or for any manual readjustment of the dampening unit roller and transfer roller over the service life of the dampening unit roller.

In order to adapt the pressure of the transfer roller against the dampening unit roller to different printing conditions, the magnitude of the regulating force may, of course, be adjustable. If the regulating force acting on the transfer roller is, for example, a spring force applied by a spring, the spring force taking effect during pressing may be adjustable by means of a variation in the prestress of the spring.

Preferably, the transfer roller is held solely by the action of the regulating force during the dampening of the printing form on the rotating dampening unit roller and is therefore not additionally fixed.

However, the scope of the invention also includes a design variant, in which the transfer and dampening unit rollers are stationary or rotate at the same circumferential speed, so that no shear forces take effect in the roller nip formed by the two rollers, when the transfer roller is thrown against the dampening unit roller with a pressing pressure determined by the regulating force, for example in a sprung manner. The relative position, set by means of the regulating force, of the transfer roller in relation to the dampening unit roller can thereafter be secured by means of an additional fixing device, for example a clamping device, so that, when a roller rotation drive is subsequently switched on or changed over, for dampening the printing form, to roller rotation at different circumferential speeds or rolling slip, the fixed pressing pressure is maintained. In this design variant, variations in the diameter of the two rollers are compensated, even before fixing, by means of the regulating force—here a compensating force.

In accordance with another feature of the invention, which is advantageous in terms of as small a number of gaps as possible in the transport path of the dampening medium from the dampening medium container to a printing form, the dampening unit roller is a dampening applicator roller which can be set selectively in bearing contact against the printing form or at a distance from the printing form. In specific applications, however, the dampening unit roller may, in contrast, also be a further transfer roller which transfers the dampening medium from the first-mentioned transfer roller onto a dampening applicator roller.

In accordance with a further feature of the invention, which is likewise advantageous in terms of as small a number of gaps as possible in the transport path of the dampening medium, the transfer roller is a metering roller which is in rolling contact with the pan roller. In this embodiment, the transfer roller thus has a double function, in that the transfer roller, on the one hand, transfers the dampening medium taken over from the pan roller onto the dampening unit roller and, on the other hand, together with the pan roller, forms a roller nip of adjustable size for producing the dampening medium film and for metering the dampening medium.

In an embodiment which is advantageous in terms of a displacement of the transfer roller into a washing position separated from the dampening unit roller, the transfer roller is capable, by means of a roller setting drive, of being displaced at a distance from the dampening unit roller counter to the resilient return effect of the regulating force.

In an embodiment which is advantageous in terms of the design of the dampening unit as a direct film dampening unit, the transfer roller is driven by a roller rotation drive at a circumferential speed differing from the circumferential speed of the dampening unit roller.

In this context, the possibility, already referred to, that the transfer roller forms, with the two rollers adjacent to it, two different roller nips, each performing a special function, is particularly favorable.

In the slip-through nip formed by the transfer roller together with a dampening unit roller, faults in the dampening medium film located on the dampening unit roller, which originate from the printing image of the printing form, are blurred in the circumferential direction, the transfer roller preferably rotating more slowly than the dampening unit roller.

The roller nip formed by the transfer roller together with the pan roller serves, as already mentioned, for producing a film, and the transfer roller functioning as a metering roller can roll without rolling slip on the pan roller.

The small number of only three rollers in the roller train transporting the dampening medium from the dampening medium container to the printing form is advantageous, particularly when the dampening unit is designed as a direct film dampening unit, a highly stable printing ink/dampening medium emulsion being ensured if an alcohol-free dampening medium or alcohol-substitutes in the dampening medium are used.

In accordance with again a further embodiment which is likewise advantageous in terms of a design of the dampening unit as a direct film dampening unit, the transfer roller is driven by a roller rotation drive at a circumferential speed that differs from the circumferential speed of the rotating printing form dampened by the dampening unit. In a preferred embodiment, the transfer roller rotates substantially more slowly, that is to say at a lower circumferential speed, than the printing form.

In an embodiment which is advantageous in terms of the prevention or at least the sufficient reduction of fluctuations in the normal force between the transfer roller and the dampening unit roller during printing, said fluctuations being caused, for example, by deformed or nonround rollers, the common pivot axis of the transfer roller and of the pan roller is designed as a rotary bearing which is rotatable smoothly in a first direction of rotation and sluggishly in a second direction of rotation, so that the transfer roller is capable of being pivoted about the rotary bearing against the dampening unit roller smoothly and away from the dampening unit roller sluggishly. This special design of the pivot axis ensures an accurately reproducible movement of throwing the transfer roller onto the dampening unit roller and, at the same time, a damping of the movement of throwing the transfer roller off the dampening unit roller.

The rotary bearing described below constitutes, on the one hand, an advantageous development of the rotary bearing of the last-described embodiment of the dampening unit according to the invention and, on the other hand, an autonomous invention independent of the dampening unit.

The rotary bearing on a machine processing a print carrier, in particular on a printing machine, in particular as the dampening unit rotary bearing forming the pivot axis, is distinguished either in that a freewheel coupling, inherently smoothly rotatable, is slidably mounted, so as to be sluggishly rotatable, in a joint bore and a joint pin is inserted fixedly in terms of rotation into the freewheel coupling (first variant) or in that a freewheel coupling, inherently smoothly rotatable, is slidably mounted, so as to be sluggishly rotatable, on a joint pin and is inserted fixedly in terms of rotation into a joint bore (second variant).

It is specific to the two alternative variants of the rotary bearing that a machine part, for example a roller carrier carrying the pan roller and the transfer roller of the dampening unit, said machine part being mounted in the rotary bearing, is rotatable or pivotable about the rotary bearing smoothly in a first direction of rotation and sluggishly in a second direction of rotation.

During the rotation of the machine part in the first direction of rotation, an inherent rotation of the freewheel coupling in its freewheeling rotation direction takes place. In this case, there is no or at least no appreciable rotation within the sliding bearing which is formed, in the first variant, by the freewheel coupling or its outer ring together with the joint bore and which is formed, in the second variant, by the freewheel coupling or its inner ring together with a joint pin.

During the rotation of the machine part in the opposite second direction of rotation, an inherent rotation of the freewheel coupling is blocked or the return of the freewheel coupling is blocked, so that there is only rotation in the sliding bearing formed by the freewheel coupling together with the joint bore or together with the joint pin.

Freewheel couplings per se are machine elements which are often used in mechanical engineering. Reference may nevertheless be made, at this juncture, to the manual "Konstruktionselemente der Feinmechanik" ["Construction Elements in Precision Mechanics"] (ISBN 3-446-15332-2), published by Carl Hanser Verlag Munich, Vienna 1989, Werner Krause (ed.), and, in particular, to pages 512–13 thereof. It can be gleaned, inter alia, from the manual that freewheel couplings can be divided into couplings dependent on the direction of rotation and having a positively acting directional locking mechanism and couplings dependent on the direction of rotation and having a frictionally acting directional locking mechanism. The freewheel couplings with a positively acting directional locking mechanism include freewheel couplings with a toothed directional locking mechanism which are used, for example, for ratchets and preferably movements with very low rotational speeds. For higher rotational speeds, it is preferable to use low-noise freewheel couplings with a frictionally acting directional locking mechanism which are designed, for example, as clamping-roller or clamping-body freewheels and can be delivered and used as so-called built-in freewheels, such as ball bearings.

Such a built-in freewheel is preferably used to produce the rotary bearing forming the pivot axis of the dampening unit.

In the first variant of the rotary bearing according to the invention, with a joint pin inserted fixedly in terms of rotation into the freewheel coupling, the joint pin is fastened, so as to be secured against rotation, to a further machine part. In the second embodiment with a freewheel coupling inserted fixedly in terms of rotation into the joint bore, the machine part having the joint bore is fastened, so as to be secured against rotation, to a further machine part. When the freewheel coupling is used according to the invention in order to produce the rotary bearing, there is no rotational movement transmitted to the joint pin by the machine part having the joint bore and there is also no rotational movement transmitted from the joint pin to the machine part having the pivot joint bore.

In the two variants of the rotary bearing which are described, its sluggishly moving sliding bearing may be designed so as to include a bearing bush. The advantage of using a bush is its good cutting machinability, so that the diameter fit dimension necessary for the sluggishness of the sliding bearing can be produced, for example, completely without any cutting machining of the freewheel coupling. The use of a bush to form the sliding bearing is also advantageous because the bush can function as the softer wearing part of the sliding bearing and be manufactured cost-effectively as a replacement part. Wear of the freewheel, the outer ring and/or the inner ring of which may be hardened, said wear being caused by the friction within the sliding bearing, is thus minimized.

In the first variant, the bush can be inserted fixedly in terms of rotation into a machine part, the inner wall of the bush forming the joint bore, in which an outer ring of the freewheel coupling is rotatable with comparatively high friction. The bush may, however, also be slipped fixedly in terms of rotation onto the outer ring of the freewheel coupling and, for example, shrunk on, so that the bush becomes virtually an integral part of the freewheel coupling. In this case, the outer face of the bush, together with the joint bore located in a machine part, forms the sluggish sliding bearing.

In the second variant of the rotary bearing with the freewheel coupling slidably mounted, so as to be sluggishly rotatable, on the joint pin, it is likewise possible, in a similar way, for the freewheel coupling to be seated on a bush and for this bush to be seated on the joint pin. If, for example, the inner ring of the freewheel coupling is seated, so as to be secured against rotation, on the outer face of that bush, the inner face of the bush, together with the joint pin, then forms the sluggish sliding bearing. The bush may, however, also be seated on the joint pin so as to be secured against rotation relative to the latter, the outer face of the bush, together with the inner ring of the freewheel coupling, forming the sluggish sliding bearing.

The freewheel coupling inner ring, mentioned many times in the above explanations, is often also designated as an inner star in the case of clamping-roller freewheels and as a clamping-body ring in the case of freewheel couplings with clamping bodies connected to form a ring.

The rotary bearing according to the invention is suitable for mounting any pivotable machine part which is to be pivotable in one pivoting direction with low friction and in the other pivoting direction with increased friction and therefore sluggishly. The rotary bearing may thus act as a rotational and directionally dependent shock absorber.

In accordance with another feature of the invention, the rotary bearing having a pivot axis includes a smoothly rotatable freewheel coupling slidably mounted, so as to be sluggishly rotatable, on a joint pin, and non-rotatably fixed in a pivot joint bore of a machine frame.

In accordance with another feature of the invention, the rotary bearing having a pivot axis includes a smoothly rotable freewhel coupling slidably mounted, so as to be sluggishly rotable, on a joint pin, and non-rotatably fixed in a pivot joint bore of a machine frame.

In an embodiment of the dampening unit according to the invention which is advantageous in terms of the metering of the dampening medium quantity, the transfer roller and the pan roller are mounted together in a roller carrier with an adjustable roller center distance between them. For example, by the transfer roller being displaced relative to the pan roller, the pressing of the transfer roller against the pan roller and consequently the dampening medium quantity conveyed through the roller nip formed by the two rollers pressed one onto the other can be set. In order to set the roller center distance, a setting device may be arranged on the roller carrier.

In an embodiment which is advantageous in terms of a high reproducibility of the throw of the transfer roller onto the dampening unit roller, the roller center distance between the axis of rotation of the pan roller and the axis of rotation of the transfer roller can be set, by means of an adjusting device formed on the roller carrier, by the displacement of the pan roller selectively in the direction toward the transfer roller or in the direction away from the transfer roller. Consequently, it is no longer necessary to displace the transfer roller in order to set the roller pressure, and the transfer roller can be mounted rotatably in the roller carrier in a fixed position relative to the latter. This ensures that, during the pivoting of the roller carrier about the pivot axis or about the rotary bearing which forms the latter, the transfer roller always comes to bear against the dampening unit roller at absolutely the same circumferential point on the latter. A constant distance of the transfer roller from a point of action of the regulating force on the roller carrier and a constant distance of the transfer roller from the pivot axis are also ensured, so as to rule out a variation in the pressing force of the transfer roller against the dampening unit roller, said variation being caused by any variations in these distances.

In an embodiment which is advantageous in terms of the cleaning of the pan roller, the pan roller can be brought into bearing contact against a distributor roller traversing in its axial direction. A washing fluid can thus be transferred from the distributor roller onto the pan roller, and, during the cleaning of the dampening unit, dirt located on the pan roller can be taken off by the distributor roller. In this case, the pan roller and/or the distributor roller preferably has a soft coating. For example, the pan roller is provided with a soft rubber layer on the circumference.

If the distributor roller is shorter than the pan roller, as seen in the axial direction, the circumferential end regions of the pan roller, which per se, with the distributor roller being in the middle position relative to the pan roller, project beyond the distributor roller in the axial direction, are also covered, during cleaning, as a result of the oscillation of the distributor roller, so that the pan roller is cleaned over its entire length via the distributor roller. The transfer roller may likewise be longer than the distributor roller and, for example, be of the same length as the pan roller and is also cleaned via the pan roller by being in bearing contact against the latter.

The throwing of the pan roller onto the distributor roller may be brought about by a pivoting of the roller carrier carrying the pan roller about the pivot bearing.

In an embodiment which is advantageous in terms of the cleaning of the transfer roller, the transfer roller can be brought into bearing contact against an axially traversing distributor roller. The distributor roller rolling on the transfer roller can thus transfer a washing fluid onto the transfer roller and take off dirt, for example printing ink residues, from the latter. In order to throw the transfer roller onto the distributor roller, the roller carrier carrying the transfer roller may be pivotable about the rotary bearing, in which the roller carrier is mounted rotatably and which forms the pivot axis.

If the distributor roller in this embodiment is shorter than the transfer roller, as seen in the axial direction, during the cleaning of the transfer roller the oscillation of the distributor roller results, in principle, in the same advantages as those afforded in the cleaning of the pan roller via the distributor roller, said cleaning already being mentioned in connection with the preceding embodiment. The roller ends of the transfer roller which project beyond the distributor roller are covered by the oscillation of the distributor roller, so that the transfer roller is cleaned over its entire length via the distributor roller. In this case, the pan roller may be longer than the distributor roller and, for example, be exactly as long as the transfer roller and also be cleaned via the latter, the pan roller bearing against the transfer roller.

The pan roller and the transfer roller, which is designed as a metering roller, should be axially longer than the dampening unit roller, designed, in particular, as a dampening applicator roller, so that the transfer of so-called lateral water margins into the region of the printing image is avoided.

When dampening units are in operation, such water margins are often formed, due to the interaction of the pan roller and metering roller, on those circumferential regions of the pan roller and metering roller which are located at both ends and are near the roller edges. The watery circumferential strips may, as measured from the respective side edge of the roller, extend about 1 centimeter in the direction of the other roller end. Since the water margins are formed on circumferential regions projecting beyond the dampening unit roller in the axial direction, this water excess is not transferred onto the dampening unit roller and not from the latter onto the printing form. Thus, since the pan roller and metering roller are designed to be somewhat longer than the dampening unit roller, this affords a technical solution avoiding water margin effects which impair the print quality.

In a possible design of the dampening unit according to the invention as an alcohol dampening unit, in which the pan roller and the transfer roller do not carry ink, the technical solution found does not present any other problems.

In the preferred design of the dampening unit according to the invention as a direct film dampening unit, the pan roller and the transfer roller are ink-carrying and, for this purpose, are each provided, for example, with a circumferential hard or soft rubber layer. Where the direct film dampening unit is concerned, it is therefore necessary, in contrast to the alcohol dampening unit, for the pan roller and the transfer roller also to be capable of being cleaned. In order to clean the pan roller and the transfer roller, which is designed as a metering roller, the washing fluid must be supplied to the pan roller or the transfer roller via a further roller which, for this purpose, rolls on the pan roller or on the transfer roller during cleaning.

For example, in a first cleaning variant, the washing fluid is transferred from the further roller to the transfer roller and from the transfer roller onto the pan roller. In this case, the further roller serves for transporting away, in the opposite direction to the supply of washing fluid, the printing ink residues to be removed from the pan roller and the transfer roller during cleaning. In this case, the transfer roller and/or the further roller (distributor roller) preferably has a soft coating. It is also possible, according to a second cleaning variant, for the printing ink residues located on the transfer roller to be taken off from the pan roller and for the printing ink residues located on the pan roller to be taken off from the further roller rolling on the pan roller during cleaning, that is to say the transfer roller is co-washed via the pan roller. The pan roller and/or the further roller (distributor roller) in this case preferably have a soft coating.

In both cleaning variants, it is beneficial if the further roller is designed as a distributor roller which traverses axially during cleaning and the stroke width of which is dimensioned such that, during cleaning, the distributor roller also covers those circumferential regions of the pan roller or metering roller which are on both sides and on which the dirty water margins or emulsion margins are located. It is also beneficial if the lateral stroke width is dimensioned such that both the left side edge and the right side edge of the distributor roller terminates a little way beyond the corresponding side edge of the respective roller, that is to say the pan roller or the transfer roller, onto which the distributor roller is thrown during cleaning.

In an embodiment which is advantageous in terms of designing the dampening unit so as to be capable of being set with a particularly high degree of metering accuracy, at least two rollers roll on the pan roller, one roller of which can be set selectively in bearing contact against an axially traversing distributor roller or at a distance from the distributor roller. Preferably, the two rollers are formed by the transfer roller and a squeezing roller, and, as seen in the direction of rotation of the pan roller, the squeezing roller follows the pan roller circumferential region dipping into the stored dampening medium and precedes the bearing point of the transfer roller against the pan roller. The squeezing roller is, in this case, that roller which, for example for cleaning purposes, is capable of being thrown onto the distributor roller.

On grounds of avoiding lateral water margins on the squeezing roller, which have an adverse effect in the printing region, the axial length of the squeezing roller may be somewhat longer than that of the distributor roller and be dimensioned so as to be the same length as the pan roller and the transfer roller, in which case, in a similar way to the embodiments already described above, the circumferential end regions of the squeezing roller, which, with the distributor roller in the middle position, project beyond the side edges of the distributor roller, are also covered as a result of the oscillation of the distributor roller while the squeezing roller is being cleaned via said distributor roller. The cleaning of the squeezing roller and, via the latter, the cleaning of the pan roller and of the transfer roller bearing against the pan roller, is carried out, in the way described in connection with the two preceding embodiments, by means of a cleaning device assigned to the inking unit which, during cleaning, is connected to the dampening unit via a roller train.

In accordance with again an added feature of the invention, which is advantageous in terms of the smoothing of the dampening medium and, if the dampening unit is designed as a direct film dampening unit, in terms of the formation of an emulsion and the smoothing of the emulsion before application to the printing form, the distributor roller is in rolling contact with the dampening unit roller during dampening. For example, the distributor roller may be in permanent bearing contact against the dampening unit roller designed as a dampening applicator roller.

In accordance with again an additional feature of the invention, which is advantageous in terms of the bearing of the transfer roller against the dampening unit roller in a way unimpaired by drive influences, the roller rotation drive driving the transfer roller is pivotable, together with the transfer roller, about the pivot axis offset relative to the roller axis of the pan roller. For example, the roller rotation drive is an electric motor and is fastened to the roller carrier carrying the transfer roller and pivotable about the pivot axis. It is thus possible to transmit the drive forces, generated by the roller rotation drive, for driving the transfer roller and for generating the rolling slip of the transfer roller relative to the dampening unit roller from the roller rotation drive to the transfer roller, in such as way as to avoid a torque which is exerted on the roller carrier by the drive forces, pivots the roller carrier about the pivot axis and is in the same direction as or opposite to the action of the regulating force on the roller carrier.

In many cases, it may be necessary to have an electric motor arrangement which differs from this embodiment and is external to the roller carrier, the drive forces being transmitted from the electric motor to the transfer roller via a gear comprising, for example, a toothed belt or gearwheels. In these cases, it is advantageous to arrange the gear in such a way that the line of action of the drive force, which corresponds, for example, to the belt run, runs through the pivot axis or at least near to the pivot axis. In this way, even when the electric motor is arranged externally to the roller carrier, drive-induced torques having a disturbing effect on the bearing of the transfer roller against the dampening unit roller and exerted on the roller carrier are avoided.

The dampening unit according to the invention and its embodiments are suitable particularly for offset rotary printing machines and may also be employed for dampening the planographic printing form on printing machines which print by direct planographic printing (direct lithography) without rubber blanket cylinders.

In accordance with a preferred embodiment of the invention, the dampening unit is designed as an emulsion film or direct film dampening unit, by means of which a high print quality is achieved without the use of alcohol or alcohol substitutes, which requires no cooling since it is highly operator-friendly, and by means of which shorter drying times for the printed sheets and a more favorable proving behavior with fewer starting discards, as compared with alcohol dampening units.

Other features which are considered as characteristic for the invention are set forth in the appended claims.

Although the invention is illustrated and described herein as embodied in a dampening unit of a planographic printing machine, it is nevertheless not intended to be limited to the details shown, since various modifications and structural changes may be made therein without departing from the spirit of the invention and within the scope and range of equivalents of the claims.

The construction and method of operation of the invention, however; together with additional objects and advantages thereof will be best understood from the following description of specific embodiments when read in connection with the accompanying drawings.

DESCRIPTION OF THE PREFERRED EMBODIMENTS

Figure 1:
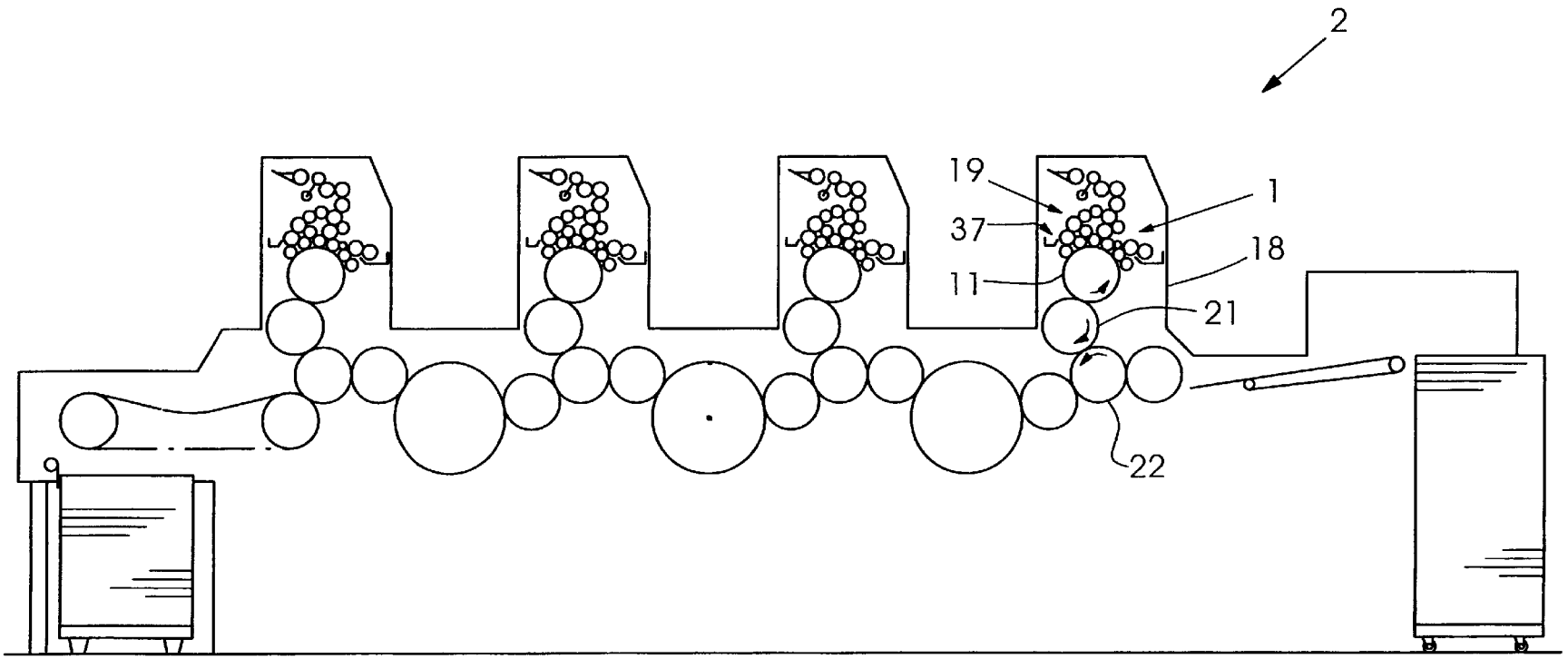
FIG. 1 is a diagrammatic view of a planographic printing machine containing the dampening unit according to the invention.

Referring now to the figures of the drawing in detail and first, particularly, to FIG. 1 thereof, there is seen a planographic printing machine 2. The exemplary embodiment is a rotary printing press with a plurality of offset printing units 18. Each of the printing units 18 comprises a printing form cylinder 11, a rubber blanket cylinder 21, and an impression cylinder 22 for the printing of print carrier sheets. In this case, a printing form 12 tension-mounted on the printing form cylinder 11 is dampened by a dampening unit 1 and inked by an inking unit 19.

Figure 2A:
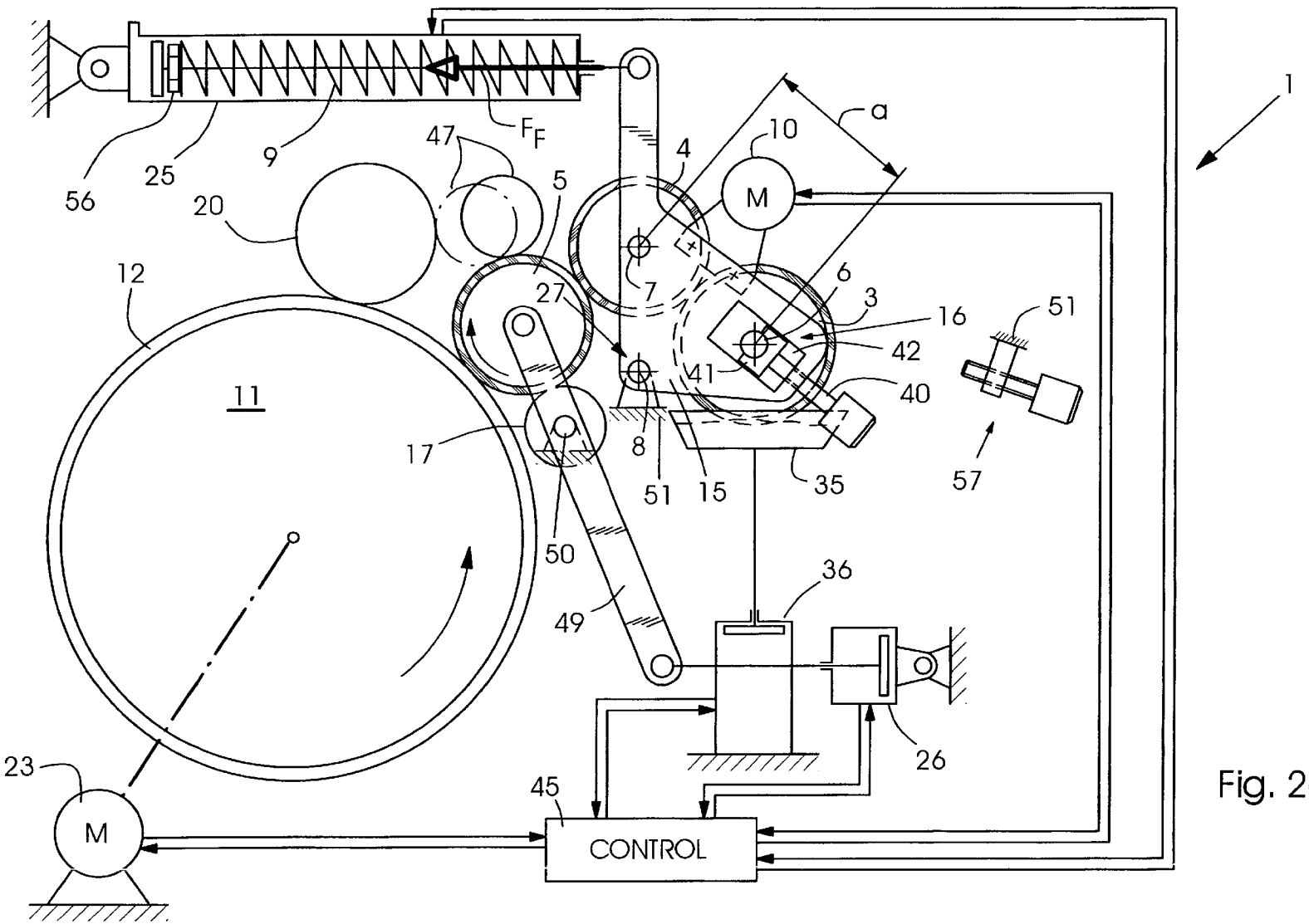
FIG. 2*a* is a partly schematic side view of a first embodiment of the dampening unit in the dampening mode.

With reference to FIG. 2*a,* there are illustrated details of the dampening unit 1 during the dampening of the printing form 12. The dampening medium stored in a dampening medium container 35 is conveyed to the printing form 12 via a roller train, the so-called water train, including a first roller or pan roller 3, a second roller or dampening unit roller 5 and a third roller or transfer roller 4. The pan roller 3 (or dip roller) scoops the dampening medium out of the dampening medium container 35 and, together with the transfer roller 4 functions as a metering roller, forming a press nip for metering the dampening medium. The transfer roller 4 transfers the dampening medium taken over from the pan roller 3 onto the dampening unit roller 5 which is a dampening applicator roller and by means of which the dampening medium is applied to the printing form 12.

During the dampening of the printing form 12, the dampening unit 1 is supplied from the inking unit 19 with printing ink which passes from the inking unit roller, designed as an ink applicator roller 20, via the connecting roller 47 bearing against the latter (dashed and dotted line), onto the dampening unit roller 5 and from that partially onto the transfer roller 4 and onto the pan roller 3. The rollers 3, 4 and 5 forming the dampening medium transport path are provided circumferentially with an ink-carrying coating, in particular the pan roller 3 and the dampening unit roller 5 having a comparatively soft casing consisting, for example, of soft rubber 55, and the transfer roller 4 having a comparatively hard casing consisting, for example, of hard rubber 54. The connecting roller 47 and a distributor roller 17 or vibrator roller 17, which permanently bears solely against the dampening unit roller 5, are likewise designed to be ink-friendly on the outside and, for this purpose, may be coated with RILSAN® or be encased with hard rubber, so that a printing ink/dampening medium emulsion enriched to a greater or lesser extent with dampening medium is located on each of the rollers 3 to 5, 17 and 47.

For uncoupling the dampening unit 1 from the inking unit 19, the connecting roller 47 is displaceable into a position (unbroken line) distanced from the ink applicator roller 20, while it maintains contact with the dampening unit roller 5. The pan roller 3 and the transfer roller 4 are jointly mounted rotatably in a roller carrier 15.

The roller carrier 15 consists of two identical bearing plates 15, between which the rollers 3 and 4 are mounted. The roller carrier 15 is pivotable about a carrier pivot bearing 27 arranged on the machine stand 51. The carrier pivot bearing 8 forms a pivot axis 8 spaced from and parallel to the roller axes 6 and 7 of the rollers 3 and 4, respectively.

A spring 9 generates a regulating or spring force $F_F$ acting on the roller carrier 15 and pivoting the latter counterclockwise about the pivot axis 8. Consequently, the transfer roller 4 is pressed resiliently against the dampening unit roller 5. The regulating force $F_F$ causes self-regulating pressing which keeps constant the pressing force of the transfer roller 4 against the dampening unit roller 5 in the event of changes in the circumferential speed of the dampening unit roller 5. The magnitude of the regulating force $F_F$ can be set by means of a force setting device 56. By means of the force setting device 56, it is possible to set the prestress or bias of the spring 9 when the transfer roller 4 bears against the dampening unit roller 5, as shown. The force setting device 56 may be a screw nut capable of being screwed onto a spring rod, onto which the spring 9 is slipped, so that the spring 9 is compressed by the amount of prestress necessary.

Figure 2B:
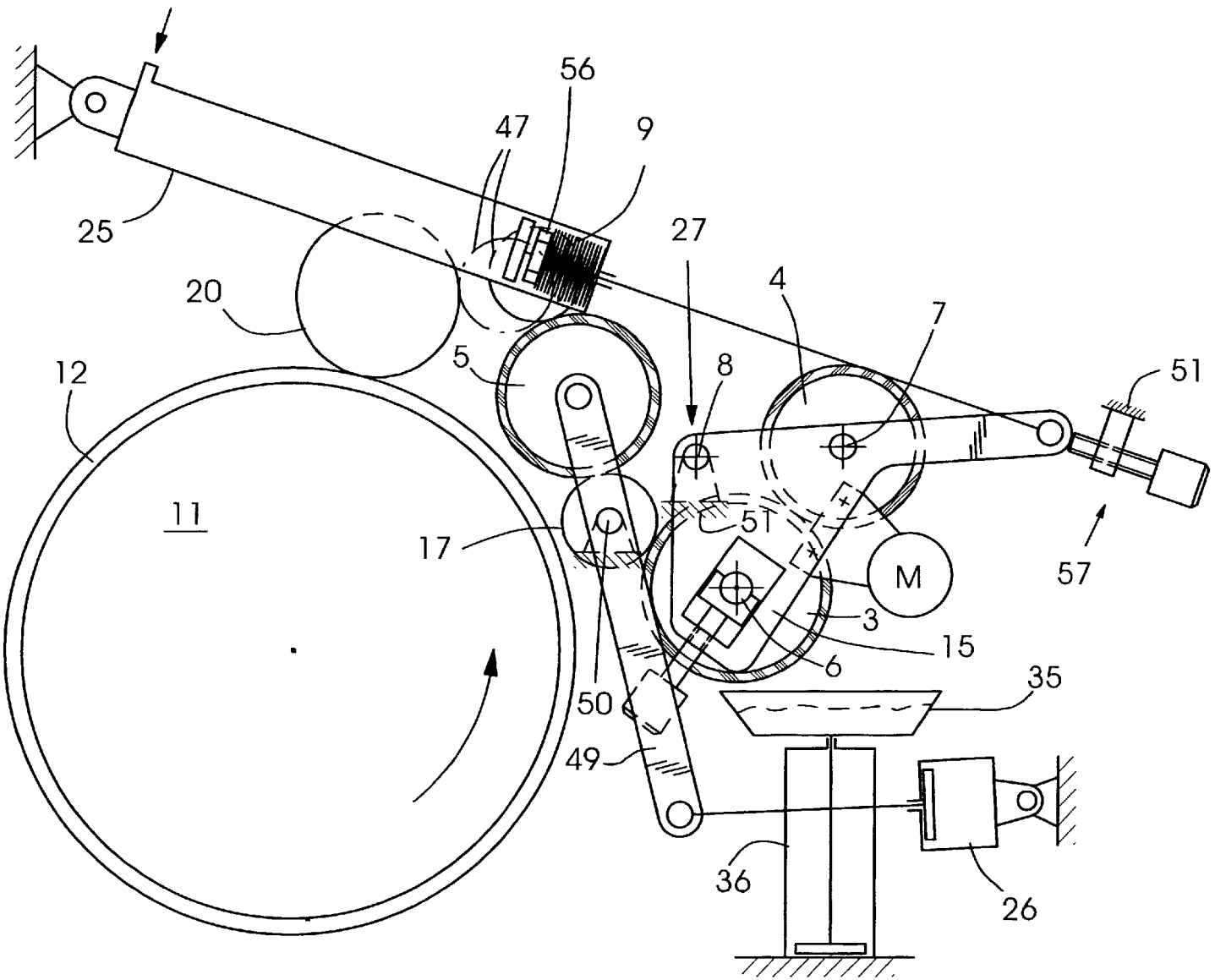
FIG. 2*b* is a similar view of the dampening unit of FIG. 2*a* in the cleaning mode.

By means of a carrier setting drive 25 that engages on the roller carrier 15, the roller carrier 15 and, together with the carrier, the rollers 3 and 4 are pivotable clockwise counter to the action of the regulating force $F_F$, so that the transfer roller 4 is pivotable into the position, shown in FIG. 2*b*. There, it is spaced from the dampening unit roller 5. The pan roller 3 is simultaneously pivotable into the position shown in FIG. 2*b,* where it bears against the distributor roller 17.

The dampening unit roller 5 that is designed as a dampening medium applicator roller is mounted rotatably in a roller carrier 49 and, together with the latter, is pivotable about its carrier pivot bearing 50, which is fixed relative to the machine frame or stand, so that the dampening unit roller 5 can be displaced selectively into a bearing position (FIG. 2*a*) and into a throw-off position (FIG. 2*b*) in relation to the printing form 12. The carrier pivot bearing 50 is arranged coaxially to the axis of rotation of the distributor roller 17, so that the latter does not also need to be displaced during the displacement of the dampening unit roller 5. The roller carrier 49 consists of two double-armed pivoting levers which between them receive the transfer roller 5.

A carrier setting drive 26 pivoting the roller carrier 49 about the carrier pivot bearing 50 may be designed, in exactly the same way as the carrier setting drive 25 and as a container setting drive 36 raising and lowering the dampening medium container 35, as a lifting-piston cylinder which is capable of being loaded with pressure fluid and is, for example, pneumatic.

An electronic control device 45 not only controls the drives 25, 26 and 36 in coordination with one another, but also controls an electromotive roller rotation drive 10, driving the transfer roller 4 and the pan roller 3 and fastened to the roller carrier 15, in speed-compensated coordination with an electromotive cylinder rotation drive 23 driving the printing form cylinder 11. The control device 45 controls the roller rotation drive 10 likewise in a speed-compensated manner in relation to a roller rotation drive which drives the transfer roller 5 and which, when the dampening unit 1 is designed in a functional unit, as shown, is formed by the cylinder rotation drive 23.

The following is achieved in this way: in the event of changes in the printing speed, the circumferential speed of the rollers 3 and 4 follows up the respective change correspondingly. During dampening, however, the rollers 4 and 5 roll on one another at circumferential speed differing from one another, the percentage speed difference between the circumferential speed of the damping unit 5 and the circumferential speed of the transfer roller 4 being predeterminable by means of the control device 45. The control device 45 activates the roller rotation drive 10 in such a way that, in the event of a change in the printing speed, the predetermined speed difference is maintained or a characteristic curve corresponding to the variation in the printing speed is followed up. The transfer roller 4 rotates at a lower circumferential speed than the dampening unit roller 5. As a result of a change in the differential speed between the rollers 4 and 5—the change is programmed or may be made by the press operator at the control device 45—the dampening medium quantity transferred onto the dampening unit roller 5 by the transfer roller 4 during dampening can be set.

The transfer roller 4 bears permanently against the pan roller 3, the rollers 3 and 4 also rolling on one another with a slight rolling slip in relation to one another. The amount of this rolling slip may be predetermined, for example, by the design of a gearwheel mechanism 43 drive-connecting the rollers 3 and 4 to one another and to the roller rotation drive 10.

The pressing of the pan roller 3 against the transfer roller 4 and consequently the layer thickness of the dampening medium film or emulsion film conveyed through the press nip formed by the two rollers 3 and 4 can be set by means of a setting device 16 for setting the roller spacing a (center distance a). The setting device 16 consists of a bearing bush or bearing shell 41 which receives the roller journal of the pan roller 3 and which is capable of being adjusted toward the transfer roller 4 and away from the latter by means of a set screw 40. The guide is implemented as a guide groove 42 which is located in the roller carrier 15 and in which the bearing shell 41 slides. The roller axis 6 can thus be adjusted along a central connecting line to the roller axis 7. For roller adjustment at both ends, a further such setting device 16 is provided on the roller carrier 15 at that roller end of the pan roller 3 which cannot be seen in FIG. 2*a*.

The regulating force $F_F$ may also be generated by a gas-pressure spring instead of by the helically coiled spring 9 capable of being tension-loaded or preferably compression-loaded. For example, for this purpose, the lifting-piston cylinder forming the roller setting drive 25 may be a double-acting lifting-piston cylinder. In the modification referred to, instead of the spring 9, a gas which is under pressure is located in the cylinder chamber receiving the spring 9. It is also possible, however, to provide, in addition to the carrier setting drive 25, a further pneumatic cylinder which generates the regulating force $F_F$ and is coupled to the roller carrier 15.

It is also possible for the regulating force $F_F$ to bring about a weight force which is derived, for example, from the intrinsic mass of the rollers 3 and 4, together with the roller carrier 15 and, if appropriate, the roller rotation drive 10. In the design of the dampening unit, as illustrated in FIG. 2*a,* however, the relative position of the masses in relation to the pivot axis 8 would generate a torque pivoting the transfer roller away from the dampening unit roller 5, so that, in such cases, an additional weighting mass may be fastened to the roller carrier 15 or coupled to the latter, for example via a cable pull mechanism, in such a way that the resultant weight forces of the weighting mass, of the rollers 3 and 4, of the roller carrier 15 and, if appropriate, of the roller rotation drive 10 yield a torque about the pivot axis 8 which pivots the transfer roller 4 onto the dampening unit roller 5.

Figure 6:
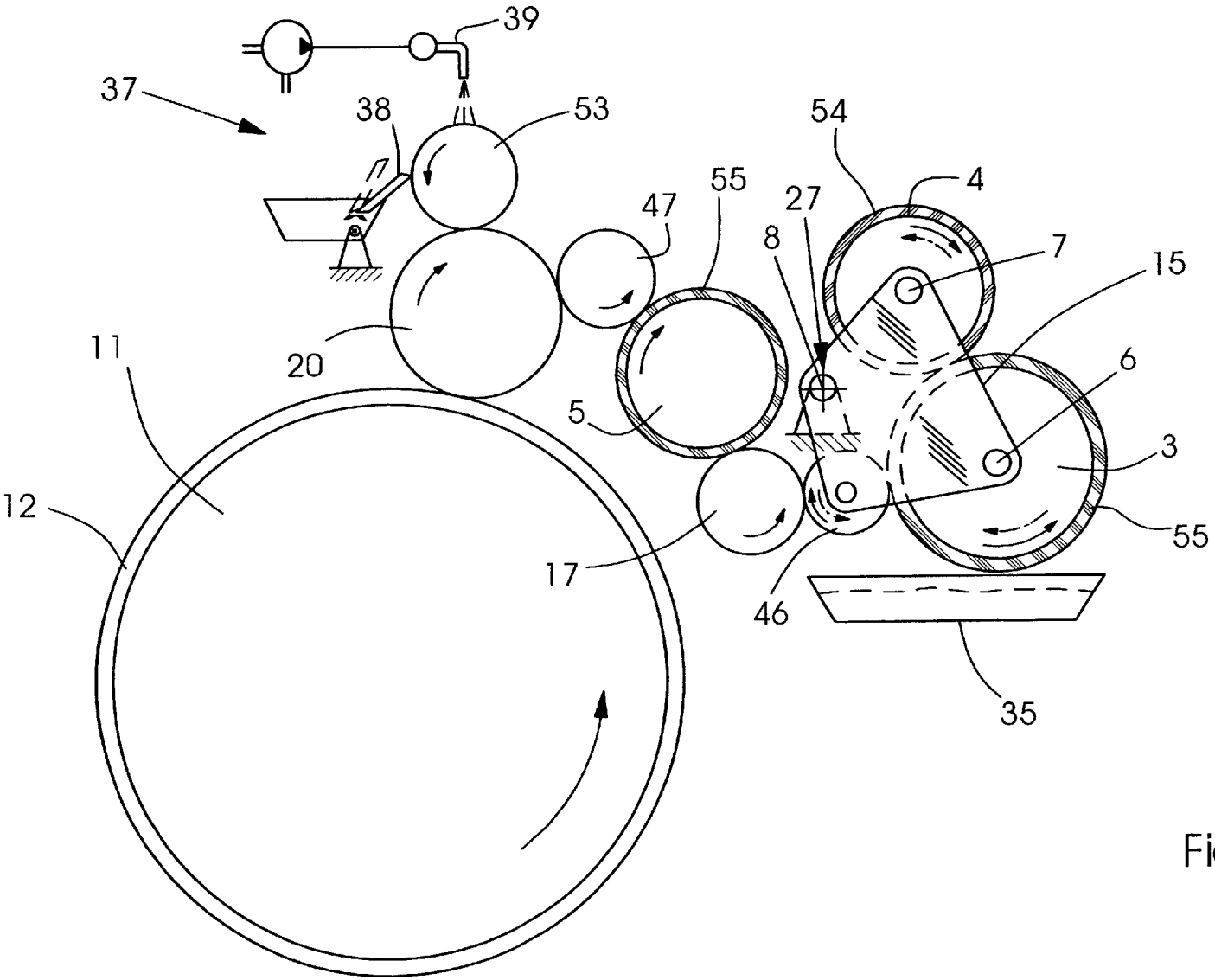
FIG. 6 is a diagrammatic side view of a second embodiment of the dampening unit.

FIG. 2*b* illustrates the dampening unit 1 during cleaning by means of a cleaning device assigned to the inking unit 19. The design and operation of the cleaning device correspond to a cleaning device 37 which is shown in FIG. 6 in connection with a design of the dampening unit 1 which is modified by the addition of a squeezing roller 46.

FIG. 2*b* illustrates that the dampening unit roller 5 is pivoted away from the printing form 12 about the carrier pivot bearing 50 by means of the extended carrier setting drive 25. The roller carrier 15 is pivoted about the pivot axis 8 by means of the extended carrier setting drive 25 into a cleaning position which is changed in relation to the dampening position (FIG. 2*a*), with the result that the transfer roller 4 is thrown off the dampening unit roller 5 and the pan roller 3 is thrown onto the distributor roller 17 which has advantageously remained in its original position.

The pressing of the pan roller 3 against the distributor roller 17 can be set by means of a setting device 57. The setting device 57 is designed as an adjustable stop limiting the stroke width of the carrier setting drive 25 and the pivot angle of the roller carrier 15 and takes the form of a setscrew screwed into the machine stand 51.

During the changeover of the dampening unit 1 out of the dampening position (FIG. 2*a*) into the cleaning position (FIG. 2*b*), the control device 45 controls the carrier setting drives 25 and 26 and the container setting drive 36 in coordination with one another as follows: first, the container setting drive 36 is activated and retracted, so that it is no longer located in the pivoting path of the pan roller 3. Thereafter, the carrier setting drive 25 is activated and extended, so that the roller carrier 15 is pivoted clockwise until the pan roller 3 bears against the distributor roller 17. Subsequently, the carrier setting drive 26 is activated and extended, so that the roller carrier 49 is pivoted clockwise and the dampening unit roller 5, designed as a dampening applicator roller, is brought out of contact with the printing form 12. The switching of the dampening unit 1 from the cleaning position (FIG. 2*b*) into the dampening position (FIG. 2*a*) takes place in reverse order.

Moreover, the carrier setting drives 25 and 26 can also be activated by means of the control device 45 in such a way that, before the inking of the printing form 12 commences, the inking unit 19 and/or the printing form 12 is predampened by means of the ink applicator roller 20 and further ink applicator rollers and, with the dampening unit roller 5 thrown off the printing form 12, the dampening unit 1 is preinked by the inking unit 19. These predampening and preinking switching arrangements of the inking unit 19 and of the dampening unit 1 differ from the switching arrangement illustrated in FIG. 2*b* in that the ink applicator roller and also the further ink applicator rollers, not shown, are thrown off the printing form 12. Such a throw-off of the ink applicator roller or rollers may, in many cases, also be expedient during the cleaning of the dampening unit 1—FIGS. 2*b* and 6.

If only the printing form 12 is predampened, the dampening flow from the dampening unit 1 to the inking unit 19 is interrupted by means of a corresponding displacement of the connecting roller 47 into its separating position (illustrated by an unbroken line) and the transfer roller 4 is thrown onto the dampening unit roller 5 and the latter onto the printing form 12.

The predampening switching arrangement for the joint predampening of the printing form 12 and of the inking unit 19 differs from the predampening switching arrangement, just described, for the predampening of only the printing form 12 merely in that the connecting roller 47 is displaced in its connecting position (illustrated by dashes and dots), so that a flow of dampening medium from the dampening unit roller 5 directly onto the printing form 12 and via the rollers 20 and 47 takes place.

A third possible predampening switching arrangement serves for the predampening of the inking unit 19 only and differs from the previously described second predampening switching arrangement for the predampening of the inking unit 19 in combination with the predampening of the printing form 12, in that the dampening unit roller 5 is lifted off from the printing form 12.

A position assumed by the dampening unit 1 during interruptions in printing differs from the dampening position (FIG. 2*a*) merely in that the dampening unit roller 5, designed as a dampening applicator roller, is lifted off from the printing form 12, the roller carrier 15 being pivoted into a middle position between the positions as shown in FIGS. 2*a* and *b*, so that the transfer roller 4 is already lifted off from the dampening unit roller 5, without the pan roller 3 bearing against the distributor roller 17. It is also possible, however, for contact between the rollers 4 and 5 to be maintained when the dampening unit roller 5 is lifted off from the printing form 12.

During the cleaning of the dampening unit 1 switched into the cleaning position (FIG. 2*b*), the washing fluid introduced into the inking unit 19 by means of a washing fluid supply 39 (FIG. 6) passes onto the transfer roller 4 via the rollers 20, 47, 5, 17 and 3 which are in rolling contact with one another, so that the washing fluid can detach printing ink residues on all the abovementioned rollers. The detached printing ink residues are transported in the opposite direction out of the dampening unit 1 into the inking unit 19, where they are removed from the inking unit 19 by means of a doctor 38 (FIG. 6) capable of being thrown onto an inking unit roller 53

Figure 3:
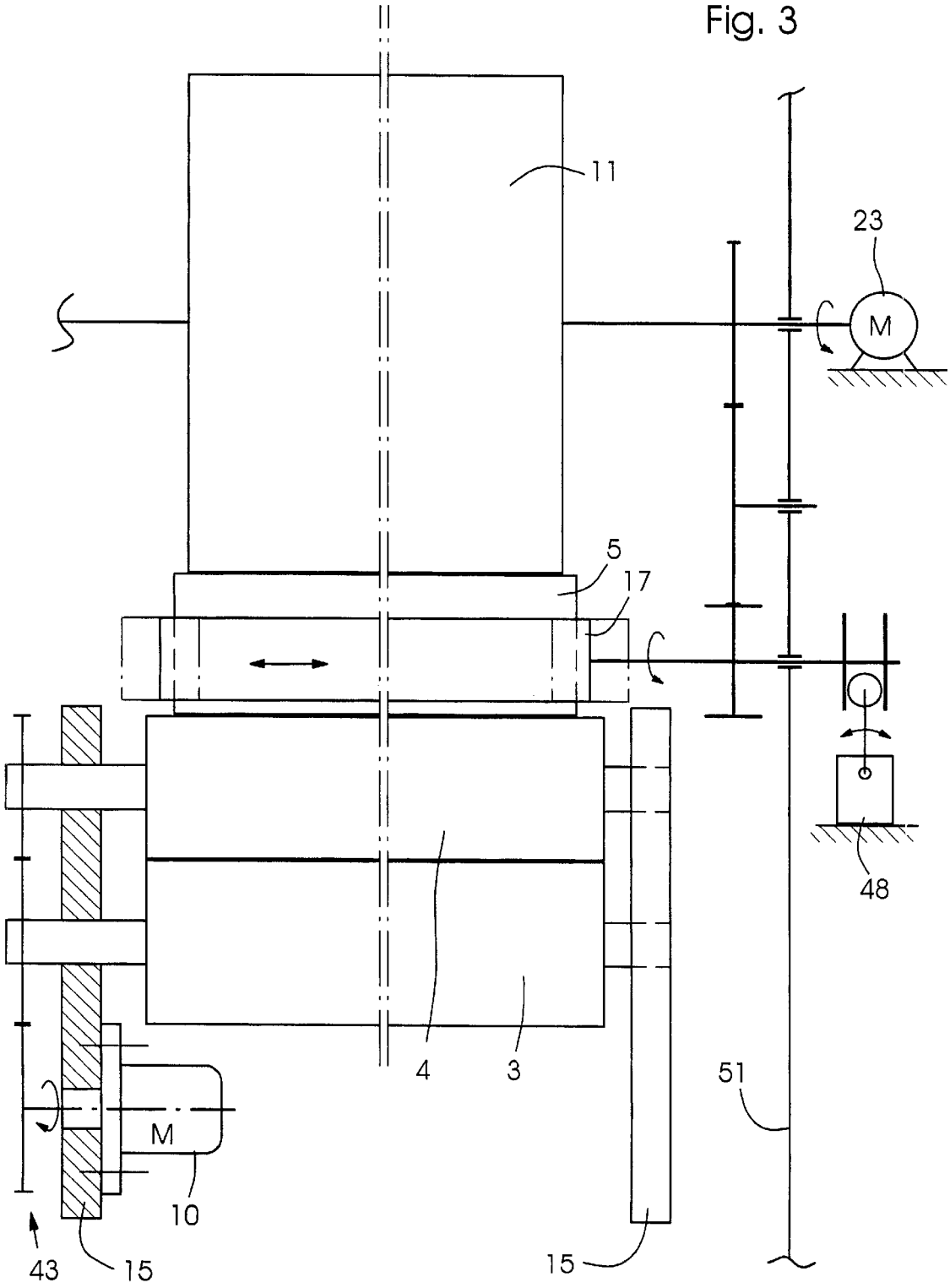
FIG. 3 is a bottom view of the dampening unit of FIG. 2*a;*

It can be seen clearly in FIG. 3 that the rollers 3 and 4 of equal length are longer than the distributor roller 17, the distributor roller 17, in turn, being longer than the dampening unit roller 5. The two lateral bearing plates are also shown, of which the roller carrier 15 consists and which, in order to increase stability, may also be connected to one another by means of one or more connecting crossmembers running parallel to the rollers 3 and 4.

The roller rotation drive 10 is an electric motor screwed to the roller carrier 15 and is arranged in a space-saving manner between the two bearing plates forming the roller carrier 1S. The gearwheel mechanism 43 consists of a gearwheel which is seated on the driveshaft of the rotation drive 10 and which engages into a gearwheel which is seated into the shaft journal of the pan roller 3 and which, in turn, meshes with a gearwheel seated on the shaft journal of the transfer roller 4. The rotation of the distributor roller 17 is driven, via a comparable gearwheel mechanism not designated in any more detail, by the cylinder rotation drive 23 driving the printing form cylinder 11.

The oscillation of the distributor roller 17 in its axial direction is driven by the traversing drive 48 which comprises a pivotable roller lever, the roller of which runs between two annular disks on the journal of the distributor roller 17. It can also be seen clearly in FIG. 3 that the distributor roller 17, during its movements to right and left, terminates beyond the respective roller end of the transfer roller 4. The position of each roller side edge of the distributor roller 17 is illustrated in bold in the middle position of the latter and by dashes and dots at the two reversal points of the distributor stroke movement.

Figure 4:
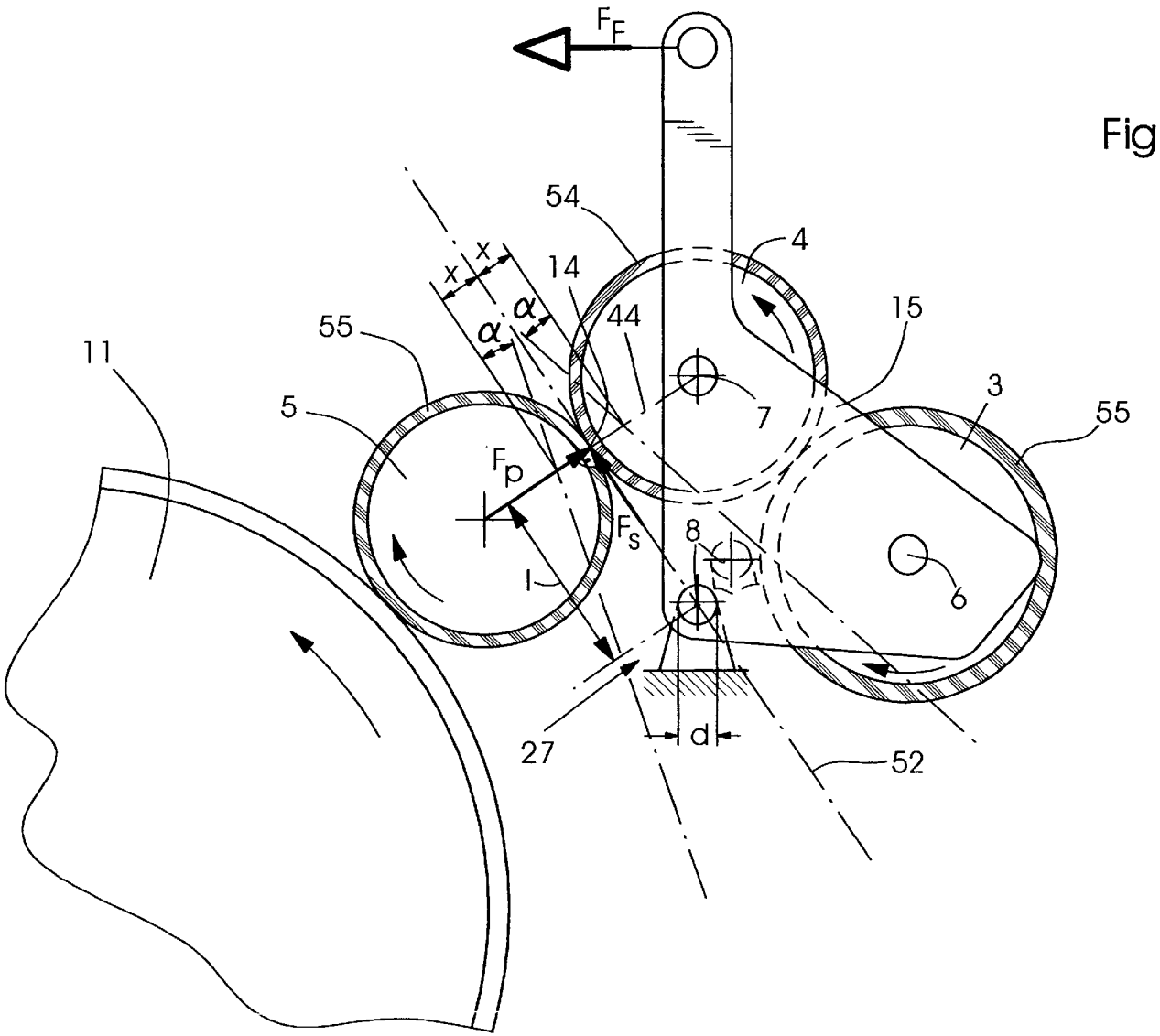
FIG. 4 is an enlarged side view of parts of the dampening unit illustrated in FIG. 2*a;*

FIG. 4 illustrates, enlarged, several parts of the dampening unit from FIG. 2*a*, parts not related to the following explanations not being illustrated. The pivot axis 8 of the carrier pivot bearing 27 (illustrated by unbroken lines) is located exactly on a tangential line 52 which runs through the contact point 14 of the rollers 4 and 5 perpendicularly to the central connecting line, corresponding to a normal line 44, of the axes of rotation of these rollers 4 and 5. A pressing force $F_P$ acts along the normal line 44 and generates a countertorque to the torque generated about the pivot axis 8 by the regulating force $F_F$.

It will be understood that the term "contact point" is used with reference to the side elevations of the drawing figures. When the transfer roller 4 and the dampening unit roller 5 are in contact, of course, they are in contact along a line stretching their entire width. That line intersects the drawing plane at the point which is referred to as the contact point 14.

The mutually different circumferential speeds of the rollers 4 and 5 gives rise to the situation where the liquid, here the printing ink/dampening medium emulsion, transported through the press nip formed by the rollers 4 and 5 is subject not only to splitting, but also to shearing by a shear force $F_S$. The line of action of the shear force $F_S$ corresponds to the tangential line 52, so that the pivot axis 8 lies on the line of action of the shear force $F_S$. This favorable arrangement of the pivot axis 8 ensures that the shear force $F_S$ cannot exert on the roller carrier 15 any torque impairing the throw of the transfer roller 4 onto the dampening unit roller 5. In the event of any variations in the magnitude of the shear force $F_S$, for example caused by changes in the circumferential speed of the rollers 4 and 5, the pressing force $F_P$ of the rollers 4 and 5 on one another, set by means of the setting device 56 and defined by the tension of the spring 9 and the magnitude of the regulating force FF resulting from the tension, remains constant.

In cases where it is not possible, for example because construction space is unavailable, to arrange the pivot axis 8 so as to lie exactly on the tangential line 52, it is beneficial to arrange the pivot axis 8 so as to lie on that side of the tangential line 52 on which the shear force $F_S$ exerts on the transfer roller 4 or the roller carrier 15 a torque about the pivot axis 8 which is in the same direction as the normal force (counterforce to the pressing force $F_P$) and in the opposite direction to the regulating force $F_F$. Such a possible alternative arrangement of the carrier pivot bearing 27 and therefore of the pivot axis 8 is illustrated by broken lines. A self-regulating pressing of the transfer roller 4 against the dampening unit roller 5 is thereby obtained. A rise in the shear force $F_S$ causes a torque which pivots the transfer roller 4 slightly away from the dampening unit roller 5 about the pivot axis 8 without loss of contact, with the result that the normal force exerted on the dampening unit roller 5 by the transfer roller 4 is automatically reduced. The magnitude of the shear force $F_S$ depends, in turn, on the normal force, so that, as a consequence of the reduction in the normal force, the shear force $F_S$ is reduced. When the pivot axis 8 is on the right side of the tangential line 52, as illustrated in FIG. 4, the dampening unit reacts in the opposite way in the event of a reduction in the shear force.

In many applications it will be sufficient if the pivot axis 8 is arranged within a wedge-shaped region around the tangential line 52. The limits of the wedge-shaped region on both sides are defined in each case by an angle $\alpha$ between the tangential line 52 and the respective limiting line. The angle $\alpha$ is smaller than or equal to 15°. The intersection point of each of the limiting lines with the normal line 44 is offset relative to the tangential line 52 by the normal distance x. The normal distance x is smaller than or equal to the product of the coefficient of static friction of the carrier pivot bearing 27 and its rotary bearing diameter d.

In the case of a carrier pivot bearing 27, not shown, having a very simple design, with a joint pin slidably mounted in a joint bore of the roller carrier 15 directly, that is to say without a freewheel and without a joint bush, the rotary bearing diameter d would correspond to the joint pin diameter or the nominal size of the sliding bearing formed by the joint pin together with the joint bore.

If the pivot axis 8 is arranged within the wedge-shaped region, it is preferable to have said pivot axis, relative to the tangential line 52, on that side (the right side in FIG. 4) on which the self-regulating pressing, already described above, of the transfer roller 4 against the dampening unit roller 5 is obtained. In the case of a comparatively short tangential distance I or lever arm of the normal force by the pivot axis 8, the latter may also be arranged somewhat outside the wedge-shaped region defined.

Figure 5:
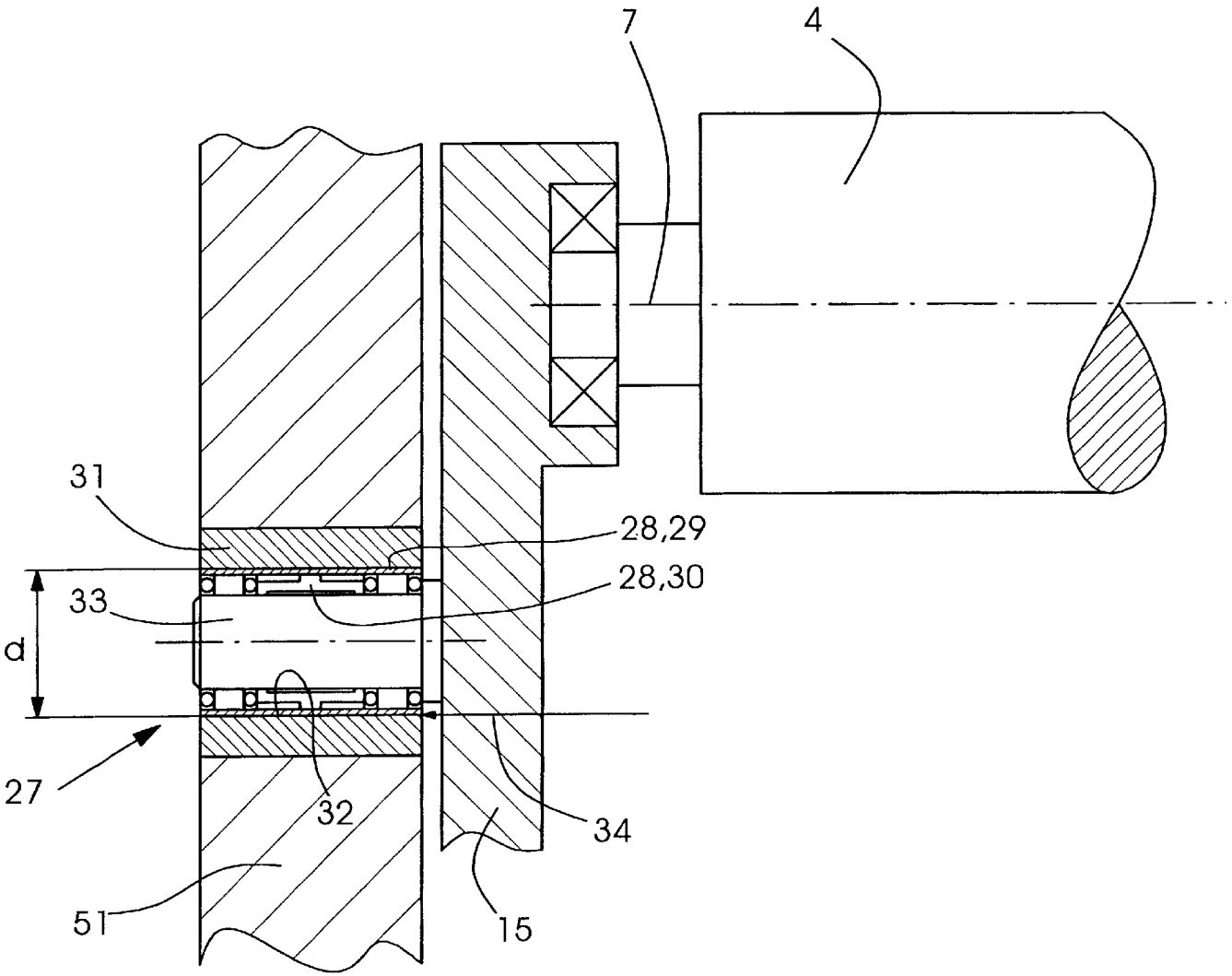
FIG. 5 is a partial side view of a rotary bearing of the dampening unit according to the first or a second embodiment.

FIG. 5 illustrates details of the carrier pivot bearing 27. A bearing bush 31 is inserted fixedly in terms of rotation into a bore in the machine stand 51. A freewheel coupling 28 is inserted rotatably into a joint bore 32 of the bearing bush 31. The freewheel coupling 28, designed in built-in form, consists of an outer ring 29 and an inner ring 30. In an alternative embodiment of the freewheel coupling 28, the inner ring may consist of a plurality of parts separate from one another and arranged in ring form comparable to the rolling bodies of a rolling bearing. In the freewheel coupling 28 shown, the outer face of the outer ring 29 forms, together with the inner face of the bush 31, a sliding bearing 34, the internal friction of which is greater than the internal friction, taking effect between the outer ring 29 and the inner ring 30, of the freewheel coupling 28 during the rotation of the latter in the freewheeling direction. The inner ring 30 is seated, secured against rotation, on a joint pin 33 which is fastened to the roller carrier 15. The rotary bearing diameter d determining the normal distance X (FIG. 4) is the nominal size of the sliding bearing 34.

FIG. 2*a* should be additionally referred to for a clearer understanding of the function of the carrier pivot bearing 27 illustrated in FIG. 5.

When the roller carrier 15 is pivoted counterclockwise about the pivot axis 8 by means of a regulating force $F_F$, a virtually frictionless rotation of the inner ring 30 taken up by the joint pin 33 takes place relative to the outer ring 29 and virtually no rotation of the outer ring 29 takes place relative to the bearing bush 31. Any temporary urging of the transfer roller 4 away from the dampening unit roller 5 as a result of pronounced hydrodynamic irregularities in the press nip between the rollers 4 and 5 is thus compensated by means of the regulating force $F_F$ smoothly and with quick reaction as a result of regulation in opposite setting directions.

When the roller carrier 15 is pivoted clockwise about the pivot axis 8, the freewheel coupling 28 is blocked, so that rotation of the inner ring 30 relative to the outer ring 29 is not possible and, in the event of rotation of the joint pin 33, the outer ring 29 is taken up by the inner ring 30. This clockwise pivoting of the roller carrier 15 takes place solely within the sliding bearing 34, the outer ring 29 sliding with comparatively high friction in the bearing bush 31 in the circumferential direction.

The sluggish clearance fit necessary for the sliding bearing 34 can be achieved solely by a dimensional adaption of the bore of the bearing bush 31 to the outside diameter of the outer ring 29 by means of cutting machining of the bearing bush bore. There is therefore no need to machine once again the outside diameter of the outer ring 29 since this outside diameter has already been ground over with high precision by the manufacturer of the freewheel coupling 28 produced as a mass product. Whilst the sliding face of the outer ring 29 is hardened, the sliding face of the bearing bush 31 consists of a material which, by comparison, is relatively soft.

The friction within the carrier pivot bearing 27, which differs depending on the direction of rotation, ensures that the urging of the transfer roller 4 away from the dampening unit roller 5 as a result of hydrodynamic irregularities is damped in such a way that abrupt fluctuations in the dampening medium film or emulsion film which have an adverse effect on the printing image are avoided.

FIG. 6 illustrates the already described dampening unit 1 in modified form, using the same reference symbols for structurally and functionally identical components. Only the differences between the modified design and the design already described are therefore discussed below. The modified design also comprises, of course, the carrier setting drive 25 and 26, the setting devices 16 and 57, the spring 9 and its force setting device 56, the container setting drive 36, the roller carrier 49 carrying the dampening unit roller 5 and its carrier pivot bearing coaxial to the fixedly mounted distributor roller 17, and also the special design of the carrier pivot bearing 27 with the freewheel coupling 28, also without these parts having been illustrated once again in FIG. 6.

Exactly as in the design already described—FIGS. 2*a* to 4—the distributor roller 17 bears solely against the dampening unit roller 5 permanently and during the dampening of the printing form 12 by the dampening unit roller 5. The function of the connecting roller 47 in the modified design is also the same as in the design already described.

The essential difference from the design already described is that, in the modified design shown in FIG. 6, a third roller in the form of the squeezing roller 46 is mounted, together with the rollers 3 and 4, in the roller carrier 15 so as to be pivotable about the pivot axis 8 and to be rotatable about its axis of rotation. The squeezing roller 46 serves for producing the dampening medium film or emulsion film in the press nip formed together with the pan roller 3 and, during dampening, bears solely against the pan roller 3.

In the design shown in FIG. 6, it may be advantageous to assign the setting device 16 to the squeezing roller 46 instead of to the pan roller 3, so that the roller center distance, determining the film layer thickness, between the roller axis of the squeezing roller 46 and the roller axis 6 of the pan roller 3 is variable as a result of a displacement of the squeezing roller 46 by means of the setting device 16. When the dampening unit is in the cleaning position, as shown in FIG. 6, the squeezing roller 46 bears against the distributor roller 17. The squeezing roller 46 is, in the axial direction, longer than the distributor roller 17 and exactly as long as the pan roller 3 and as the transfer roller 4. Circumferential end regions of the squeezing roller 46 which project laterally beyond the distributor roller 17 are also covered as a result of the traversing movement of the distributor roller 17, in the same way as in the case of the rollers 3 and 17 shown in FIG. 2*b*.

The unbroken arrows drawn inside the rollers 3, 4 and 46 symbolize the direction of rotation of these rollers 3, 4 and 46 during cleaning, when the transfer roller 4 is released from the dampening unit roller 5. The dashed and dotted arrows drawn inside the rollers 3, 4 and 46 and pointed in the opposite direction symbolize the direction of rotation of the rollers 3, 4 and 46 during the dampening of the printing form 12, when the transfer roller 4 is pivoted onto the dampening unit roller 5 and the squeezing roller 46 is pivoted away from the distributor roller 17.

The electronic control device 45—FIG. 2*a*—activates the roller rotation drive 10 accordingly, so that, both during the dampening of the printing form 12 and during the cleaning of the dampening unit 1, the remaining rollers 5, 17, 47, 20 and 53 illustrated in FIG. 6 always rotate in the same direction of rotation shown symbolically. The programmed changeover in the direction of rotation of the roller rotation drive 10 or a likewise possible uncoupling of the rollers 3, 4, and 46 from the roller rotation drive 10 and a frictional take-up of these rollers 3, 4, and 46 by the roller 17 driven positively by an electric motor ensure that, in the cleaning position—FIG. 6—, the rollers 17 and 46 roll synchronously on one another and, during the not additionally shown dampening of the printing form 12, the rollers 4 and 5 likewise roll synchronously on one another.

In the modified dampening unit, too, the cleaning device 37 functions in the way already described in connection with the unmodified dampening unit 1—FIGS. 2*a* to 6—, and it must also be stressed, at this juncture, that, by means of the washing fluid supply 39, first the washing fluid is sprayed into the inking unit 19 and, more precisely, onto the inking unit roller 53, a specific washing fluid dwell time then elapses, during which the washing fluid passes into the dampening unit 1, and only then is the doctor 38 thrown onto the inking unit roller 53.

I claim:

1. A dampening unit of a planographic printing machine, comprising:

a first roller rotatably mounted about a first roller axis;

a second roller rotatably mounted about a second roller axis;

a third roller rotatably mounted about a third roller axis;

said second roller and said third roller being ink-friendly, emulsion-carrying rollers;

a roller drive driving said third roller with a rolling slip relative to said second roller;

a common roller carrier having a pivot axis and commonly supporting said first roller and said third roller such that said first roller and said third roller are pivotably disposed about said pivot axis, said pivot axis being offset from said first roller axis, said second roller axis, and said third roller axis;

a spring coupled to said common roller carrier; and said third roller disposed to be held, by said spring generating a regulating force and with said common roller carrier, in bearing contact against said second roller at a circumferential contact point.

2. The dampening unit according to claim 1, wherein said first roller is an ink-friendly, emulsion-carrying roller.

3. The dampening unit according to claim 1, which comprises a rotary bearing defining said pivot axis, said rotary bearing being rotatable in a first direction in which said third roller is thrown onto said second roller and being rotatable in a second direction in which said third roller is thrown off from said second roller.

4. The dampening unit according to claim 3, wherein said rotary bearing having said pivot axis includes a rotatable freewheel coupling slidably mounted, so as to be rotatable, in a pivot joint bore formed in a machine frame, and a joint pin inserted and non-rotatably fixed in said freewheel coupling.

5. The dampening unit according to claim 3, wherein said rotary bearing having said pivot axis includes a rotatable freewheel coupling slidably mounted, so as to be rotatable, on a joint pin, and non-rotatably fixed in a pivot joint bore of a machine frame.

6. The dampening unit according to claim 1, wherein said common roller carrier commonly supports said third roller and said first roller, and said common roller carrier includes a setting device for setting an adjustable roller center spacing distance between said first and third roller axes.

7. The dampening unit according to claim 6, wherein said setting device for setting the adjustable roller center spacing distance on said common roller carrier displaces said first roller relative to said third roller.

8. In combination with a planographic printing machine, at least one dampening unit according to claims 1.

9. The dampening unit according to claim 1, wherein said rotary bearing includes:

a joint pin and a freewheel coupling, said freewheel coupling including an inner ring and an outer ring;

said inner ring being non-rotatably fixed on said joint pin;

an element selected from the group consisting of a pivot joint bore and a bush inserted in a pivot joint bore, said outer ring being slidably mounted on said element so as to be rotatable in said second direction; and said freewheel coupling being rotatable with respect to said rings in said first direction.

10. The dampening unit according to claim 1, wherein said rotary bearing includes:

a pivot joint bore and a freewheel coupling;

said freewheel coupling including an inner ring and an outer ring;

an element selected from the group consisting of a joint pin and a bush on a joint pin, said inner ring being slidably mounted on said element so as to be rotatable in said second direction;

said outer ring being non-rotatably fixed in said pivot joint bore; and said freewheel coupling being rotatable with respect to said rings in said first direction.

11. The dampening unit according to claim 1, which comprises a rotary bearing defining said pivot axis, said rotary bearing being rotatable in a first direction in which said third roller is pressed against said second roller, and being rotatable in a second direction in which said third roller is moved away from said second roller.

* * * * *